US007708264B2

(12) United States Patent
Kosugi et al.

(10) Patent No.: US 7,708,264 B2
(45) Date of Patent: May 4, 2010

(54) SHEET FEEDING DEVICE AND IMAGE FORMING APPARATUS

(75) Inventors: Akira Kosugi, Hachioji (JP); Daisuke Ueda, Hachioji (JP); Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/265,126

(22) Filed: Nov. 5, 2008

(65) Prior Publication Data

US 2009/0121411 A1 May 14, 2009

(30) Foreign Application Priority Data

Nov. 9, 2007 (JP) ..... 2007-291672

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS 5,110,110 A * 5/1992 Wirz et al. ..... 271/98
7,380,781 B2 * 6/2008 Ikeda ..... 271/98
7,458,570 B2 * 12/2008 Ueda et al. ..... 271/97
2004/0089994 A1 * 5/2004 Koga et al. ..... 271/98
2006/0012107 A1 * 1/2006 Ueda et al. ..... 271/98
2007/0052152 A1 * 3/2007 Gruntjes et al. ..... 271/97
2007/0228638 A1 * 10/2007 Ikeda ..... 271/97
2007/0267803 A1 * 11/2007 Tateishi et al. ..... 271/98
2008/0217838 A1 * 9/2008 Roberts et al. ..... 271/98
2008/0237968 A1 * 10/2008 Suzuki ..... 271/98

FOREIGN PATENT DOCUMENTS

JP 2003-182873 7/2003
JP 2004-043186 2/2004

* cited by examiner

*Primary Examiner*—David H Bollinger
(74) *Attorney, Agent, or Firm*—Cantor Colburn LLP

(57) ABSTRACT

A sheet feeding device, having: a sheet feeding tray which stacks a paper sheet bundle formed by a plurality of sheets; a first blower which blows air to a side edge of the paper sheet bundle stacked on the sheet feeding tray; a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet, wherein a first area in which the adsorption conveyance section is provided, and a second area in which a ventilation port of the first blower is provided, respectively includes an overlapping area in which the first area and the second area overlap on the sheet conveyance direction.

7 Claims, 9 Drawing Sheets

SHEET FEEDING DEVICE AND IMAGE FORMING APPARATUS

This application is based on Japanese Patent Applications No. 2007-291672 filed with Japanese Patent Office on Nov. 9, 2007, the content of which is incorporated herein by reference.

BACKGROUND

1. Field of the Invention

The present invention relates to a sheet feeding device used for an image forming apparatus, such as a copying machine, a printer, a facsimile, a printing machine, and a multi function peripheral, and especially relates to a sheet feeding device, which is capable of securely separating and sending out one sheet at a time, such as a coated paper sheet.

2. Description of Related Art

The above-mentioned image forming apparatus includes a sheet feeding device, which sends out one sheet from a paper sheet bundle, into which several sheets are stacked, at a time with a sheet feeding roller. In such sheet feeding device, when a plurality of sheets is multi-fed, this multi feeding becomes a cause of a paper jam. When conveyance power is small, a miss feeding easily occurs. Therefore, the sheet feeding device is arranged to securely send one sheet at a time. That is, the miss feeding is prevented by securely sending out one topmost sheet of stacked sheets by increasing a friction coefficient between a sheet feed roller and a sheet. In addition, the sheet feeding device is arranged so that only one topmost sheet is sent out by pushing back a second and subsequent sheets with separation by a separation roller and a pad separation or by a separating claw so that no more than two sheets are send out.

This method is effective as long as only a general plain paper is being used. However, recently, applications of a copying machine or a printer have expanded and sheets with various paper qualities including a coated paper sheet have come to be used. Among these sheets is a case where an adherence force between the sheets at the time of stacking is strong and it is difficult to securely prevent the multi feeding in the above-mentioned sheet feeding device occurs.

Then, a method of providing a ventilation port on a side of sending direction of stacked sheets, blowing air toward a plurality of sheets on an upper part of the stacked sheets from this ventilation port and separating sheets by passing air between sheets is proposed.

However, the coated paper sheet has a characteristic of sheets adhering each other in a high humidity environment. A paper sheet bundle, which is strongly stuck together, becomes a heavy lump at low air velocity. Therefore, the adherence of sheets does not exfoliate and a sheet cannot be raised by blowing weak air from the side.

In order to resolve this, strengthening the blowing of air for raising a sheet can be considered. However, even if a flow of air is strengthened, the sheets are only pushed up largely and separation per sheet does not become good.

Accordingly, in Japanese Patent Application Publication No. 2004-043186, a configuration in which a sheet adsorption conveyance device, which adsorbs and conveys one sheet at a time by air suction from a bundle of sheets supported with a sheet stacking device, and a blower, which blows air to an upper part of a paper sheet bundle from a forward side of a sheet feeding direction, is proposed. By blowing the air from the forward side of the paper sheet bundle, several sheets on the upper part of the paper sheet bundle are raised, and a topmost sheet of the paper sheet bundle is adsorbed and conveyed by an adsorption conveyance device. When the topmost sheet is adsorbed by the adsorption conveyance device, the air from the forward side will function so that subsequent sheets separate.

In general, although a sheet feeding using such adsorption device has a tendency to become large comparing to a roller sheet feeding, it excels in a sheet feed ability. The reason is that the sheet feeding using such adsorption device is stable in the long run without effects of wear out and slip since it is not a friction separation and is comparatively unaffected by a sheet condition, such as paper kind.

However, ventilation only from the forward side of the paper sheet bundle is insufficient for the separation of sheets. Therefore, in Japanese Patent Application Publication No. 2003-182873, a ventilation port is formed in a side regulating member, which positions both sides of the paper sheet bundle. A configuration, which blows air from a side of the paper sheet bundle by this ventilation port, is proposed. The separation of sheets improves by the ventilation from side and forward.

Apart from that, since a blower from the side of the paper sheet bundle is arranged so that the center of the ascending and descending direction of the ventilation port comes almost to the upper surface of the paper sheet bundle, the upper end of the ventilation port comes above the upper surface of the paper sheet bundle. The sheet feeding device has the paper sheet bundle loaded on the drawer-type sheet feeding tray. When supplying sheets, a sheet feeding tray is pulled out and the sheets are supplied. The side regulating member with the ventilation port from the side is attached to the sheet feeding tray. A sheet adsorption conveyance device is attached to the image forming apparatus main body. Therefore, if a blower protrudes above the upper surface of the paper sheet bundle when pulling out a sheet feeding tray for the purpose of sheet supply, the blower interferes with the sheet adsorption conveyance device and becomes impossible to move. In Japanese Patent Application Publication No. 2003-182873, in order to avoid such a situation, the blower from the side is moved and provided near the rear end of the paper sheet bundle to not to interfere with the sheet adsorption conveyance device.

However, in the configuration of Japanese Patent Application Publication No. 2003-182873, when a sheet size is small, a problem that a case where the blower from the side cannot be used occurs.

The present invention solves such problems and an object of the present invention is to provide a sheet feeding device that is capable of being disposed a blower from the side right beneath the sheet adsorption conveyance section even for small size sheets and an image forming apparatus in which this sheet feeding device is provided.

SUMMARY

According to one aspect of the present invention, there is provided a sheet feeding device, comprising: a sheet feeding tray which stacks a paper sheet bundle formed by a plurality of sheets; a first blower which blows air to a side edge of the paper sheet bundle stacked on the sheet feeding tray; a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet one by one, wherein a first area in which the adsorption conveyance section is provided, and a second area in which a ventilation port of the first blower is provided, respectively includes an overlapping area in which the first area and the second area overlap on the sheet conveyance direction.

According to another aspect of the present invention, there is provided an image forming apparatus, comprising: an image forming section which forms a toner image on an image bearing member; a transfer section which transfers the toner image formed on the image bearing member to a sheet; a sheet feeding device which conveys the sheet to the transfer section; and a fixing device which fixes the toner image transferred to the sheet by heating the sheet, wherein the sheet feeding device comprises: a sheet feeding tray which stacks a paper sheet bundle formed by a plurality of sheets; a first blower which blows air to a side edge of the paper sheet bundle stacked on the sheet feeding tray; a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet one by one, wherein a first area in which the adsorption conveyance section is provided, and a second area in which a ventilation port of the first blower is provided, respectively includes an overlapping area in which the first area and the second area overlap on the sheet conveyance direction.

Since the image forming apparatus includes the area in which an area of the adsorption conveyance section and the area of the ventilation port overlap on the sheet conveyance direction, by blowing air to the side of the paper sheet bundle even if the sheet size is small, sheets can be separated into a sheet. Since air can be blown into the sheets right underneath an adsorption conveyance section, only a topmost sheet is easily adsorbed by the adsorption conveyance section.

By this, sheet feeding in which a multi feeding does not occur even with coated paper sheets with strong adherence force in a high humidity environment becomes possible. An image forming apparatus, which is configured by a sheet feeding device, is capable of forming an image on a sheet in the image forming apparatus and the multi feeding is prevented regardless of the sheet kind.

Apart from that, in case when the ventilation port of a first blower is located near the leading edge of a sheet, small sized sheets may be possible. However, in case when the ventilation port of a first blower blows air at the leading edge of a sheet, the sheet may move forward, and the timing of sheet feeding shifts and cause a poor sheet feed.

Then, the leading edge position in the sheet conveyance direction of the ventilation port of the first blower is arranged to be behind a position of a half the length of the sheet conveyance direction of the adsorption side in the adsorption conveyance section. With this, blowing air from side to near the leading edge of a sheet will not occur and a generating of a poor sheet feed can be prevented.

By controlling an air amount of the first blower and a timing of ON/OFF for air blow of the first blower, suitable ventilation for a paper quality can be achieved and a certainty of sheet feeding increases.

DESCRIPTION OF THE PREFERRED EMBODIMENTS

An embodiment of the present invention is explained hereinafter by using drawings. However, the present invention is not limited to the embodiment described below.

Hereafter, an embodiment of the present invention is described based on the drawings.

Image Forming Apparatus

Figure 1:
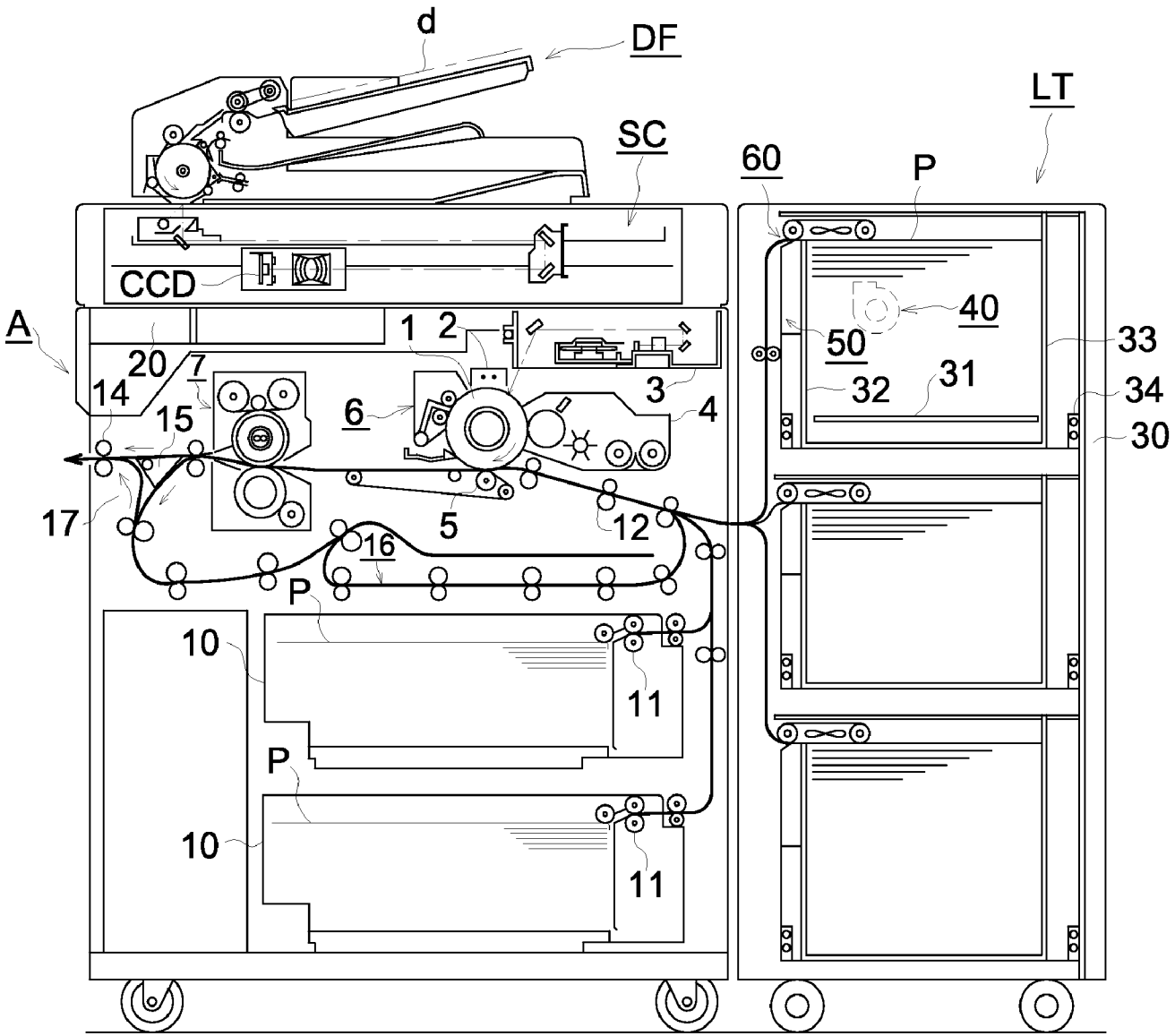
FIG. 1 illustrates an entire configuration diagram of an image forming apparatus configured by an image forming apparatus main body, an image reading device, an automatic document feeding device and a mass sheet feeding device.

FIG. 1 illustrates an entire configuration diagram of an image forming apparatus, which includes an image forming apparatus main body "A", an image reading device SC, an automatic document feeder DF and a sheet feeding device LT, which has a large capacity.

The image forming apparatus main body "A" of the drawing is configured by an image forming section, which includes a photo conductor 1 being an image support member, a charging section 2, an exposure device 3, a development device 4, a transfer section 5 and a cleaning section 6, a fixing device 7, and a sheet conveyance section.

The sheet conveyance section is configured by sheet feeding cassettes 10, first sheet feeding sections 11, a second sheet feeding section 12, a sheet delivery section 14, a conveyance pathway switching section 15, a circulation sheet re-feeding section 16, and a reversal sheet delivery section 17.

A document d placed on a document platen on the automatic document feeder DF is conveyed by a sheet feeding section. Then, an image of one side or both sides of the document d is exposed to an optical system of the image reading device SC and is read by an image sensor CCD. In an image processing section 20, after an analog process, A/D conversion, a shading correction and image compression processing have been executed, an analog signal, to which a photoelectric conversion was executed by the image sensor CCD, sends an image signal to the exposure device 3.

In an image forming section, processings of charge, exposure, development, transfer, separation, and cleaning are performed.

In the image forming section, a surface of the photo conductor 1 is charged by the charging section 2, an electrostatic latent image is formed by a laser beam irradiation from the exposure device 3, and the electrostatic latent image becomes a toner image by being visualized by the development device 4. Subsequently, a sheet P taken into the sheet feeding cassette 10 is conveyed from the first sheet feeding section 11. The sheet P is conveyed after synchronization with a toner image is taken at the second sheet feeding section 12, which is configured by registration rollers. Then, after the toner image is transferred to the sheet P by the transfer section 5, the toner image is fixed to the sheet P by the fixing device 7.

The sheet P is discharged by the sheet delivery section 14 out of device after fixing. On the other hand, toner of a transfer residue on the photo conductor 1 is removed by the cleaning section 6. In a case of duplexing coping, the sheet P, to which an image forming was executed on a first surface side, is sent to the circulation sheet re-feeding section 16 and is reversed. Then, again in the image forming section, the image forming is executed to a second surface side of the sheet P. Then, the sheet P is discharged out of the device by the sheet delivery section 14. In case of a reversal sheet delivery, the sheet P, which branched from a usual sheet delivery passage, is switched back, and the front and back sides are reversed in the reversal sheet delivery section 17. Then, the sheet P is discharged out of the device by the sheet delivery section 14.

The sheet feeding device LT, which has a large capacity, is a sheet feeding device of the present invention. The sheet feeding device LT is connected to the image forming apparatus main body "A". The sheet feeding device LT includes a sheet feeding device main body 30, a first blower 40, a second blower 50, and an adsorption conveyance section 60. The sheet feeding device LT accepts a large quantity of sheets P and feeds the sheet P one sheet at a time to the image forming apparatus main body "A".

The sheet feeding device main body 30 includes a sheet feeding tray 31, a leading edge regulating member 32, a rear end regulating member 33, and a guide rail 34. The sheet feeding tray 31 is configured by three tiers, and each sheet feeding tray 31 is configured so that it is capable of being pulled out from the sheet feeding device LT by the guide rail 34. The maximum amount of sheet feeding of the sheet feeding device LT is approximately 10,300 sheets.

Figure 2:
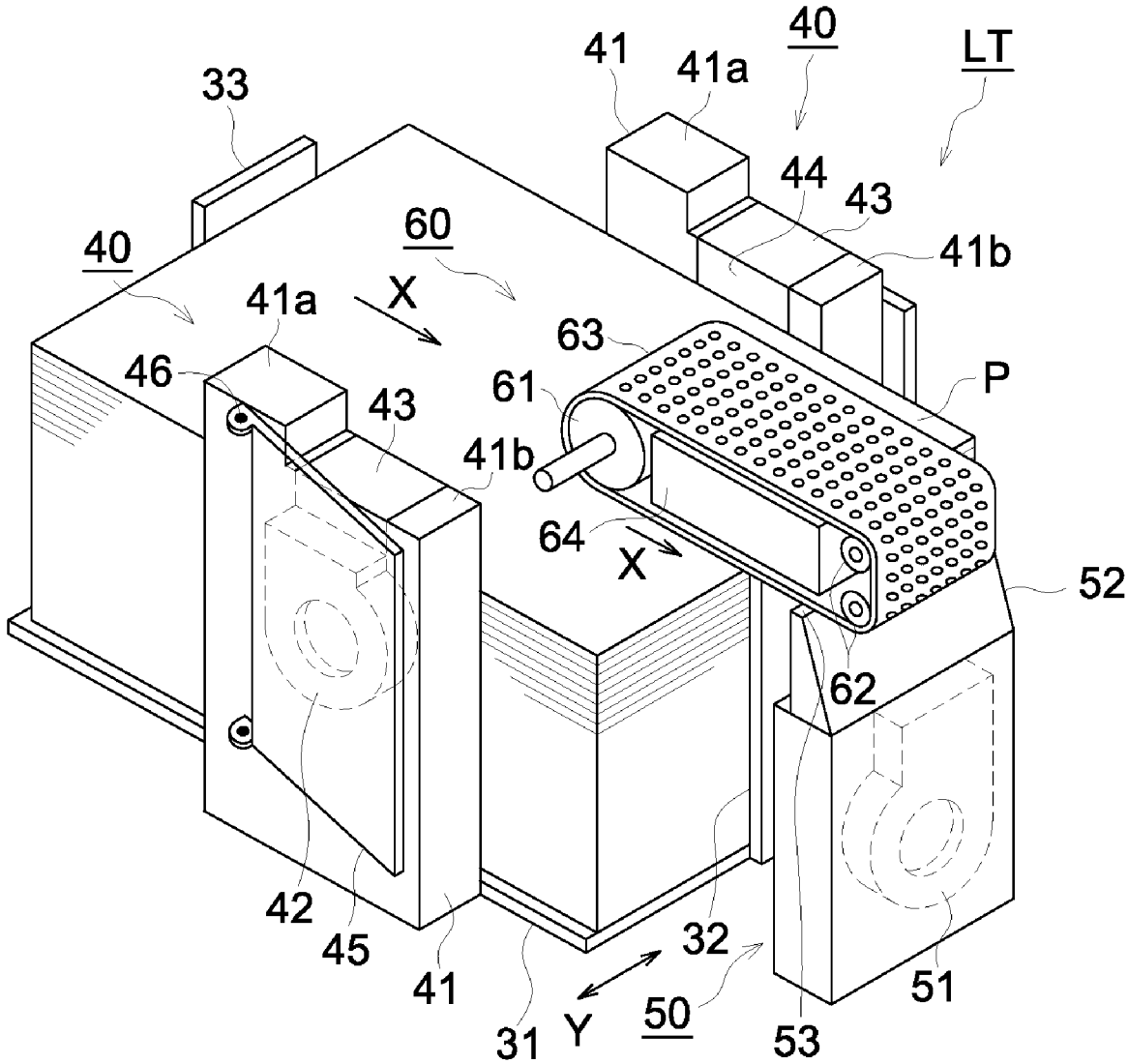
FIG. 2 illustrates a perspective view of an important section of a sheet feeding device of the present invention.
Figure 3:
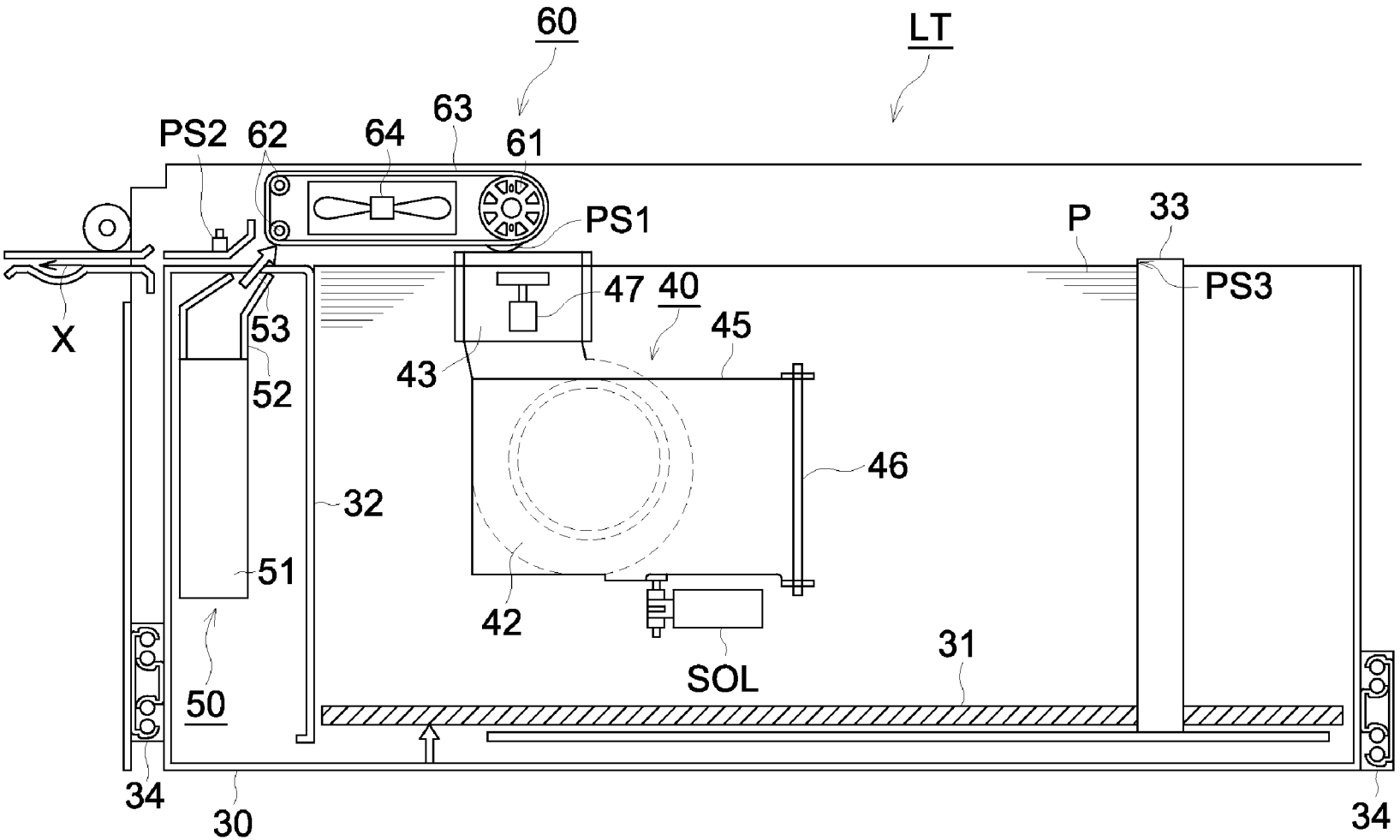
FIG. 3 illustrates a front sectional view of the sheet feeding device.
Figure 4:
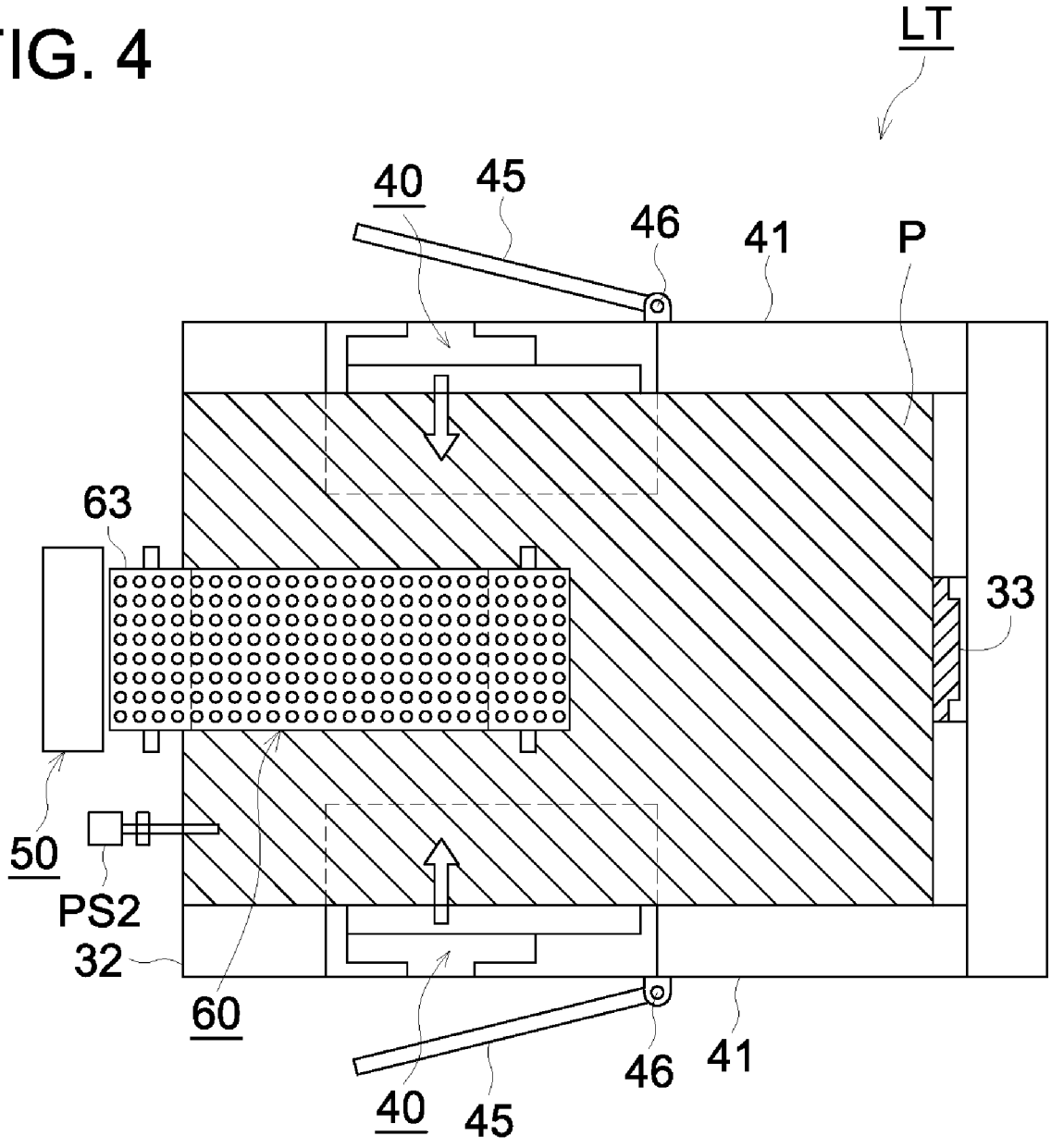
FIG. 4 illustrates a top view of the sheet feeding device.
Figure 5:
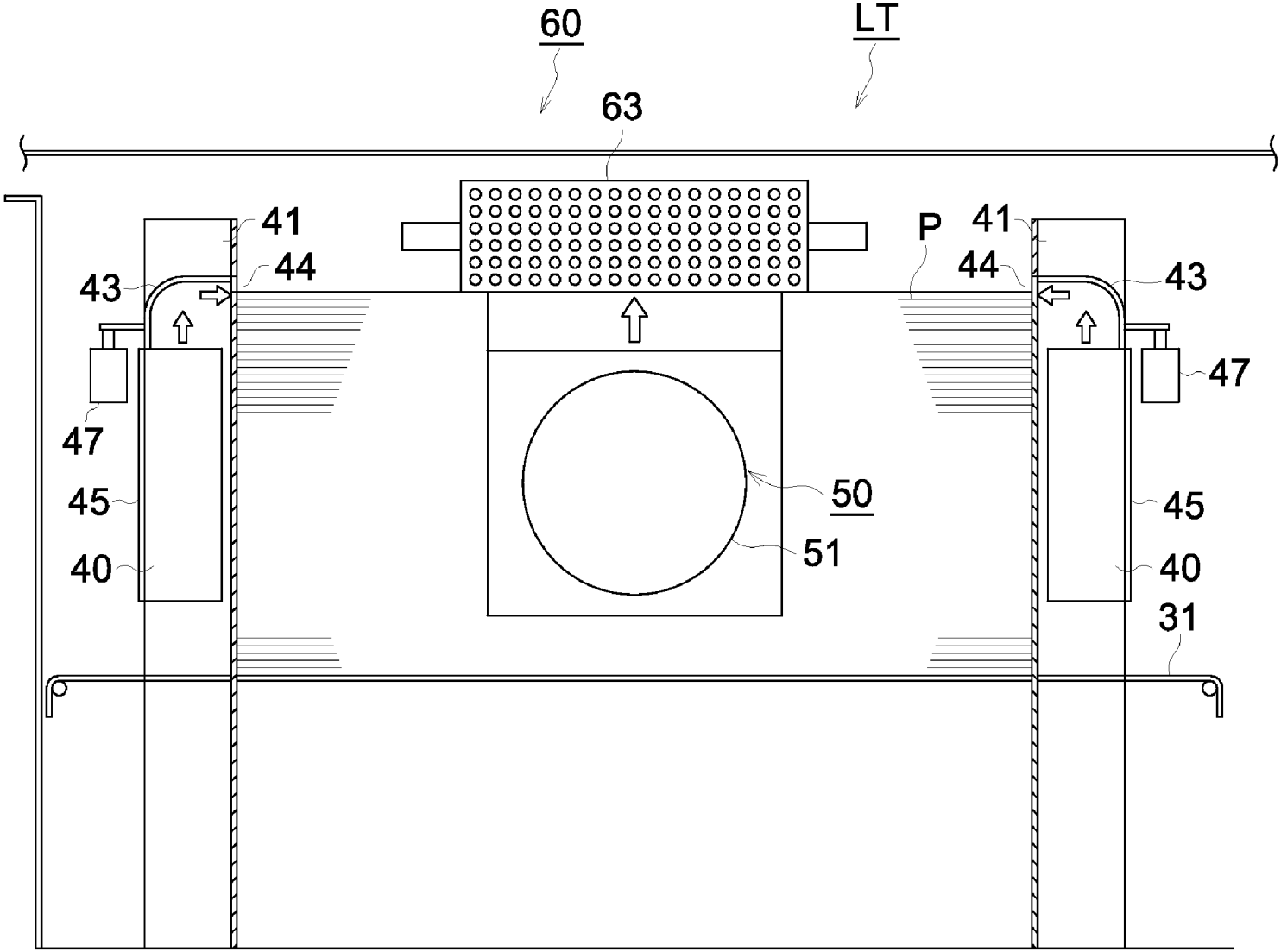
FIG. 5 illustrates a side view of the sheet feeding device.

FIG. 2 illustrates a perspective view of important section of the sheet feeding device LT according to the embodiment of the present invention. FIG. 3, FIG. 4 and FIG. 5 illustrate a front sectional view, a top view and a side view of the sheet feeding device LT according to the embodiment of the present invention respectively.

In these figures, stacked sheets P are placed on the sheet feeding tray 31, and are accepted so that it is capable of ascending and descending by the mechanism which is not illustrated. A side regulating member 41 is arranged to move freely in the sheet width direction. The side regulating member 41 regulates both sides position of the sheet P by lightly pressing both sides of the sheet P corresponding to the sheet width of the stacked sheets P. The side regulating members 41 have different levels on the top part and are arranged so that top surface 41*a* of the side regulating member 41 in an upstream side with respect to a sending direction of the sheet P is high, and upper surface 41*b* of the side regulating member 41 in the downstream side with respect to the sending direction of the sheet P is low. Although not illustrated, support members, which support the upper ends of side regulating members 41, are attached to the top surface 41*a*. In the sheet conveyance direction, areas in which the top surface 41*b* of the side regulating member 41 in a downstream side are provided, and an area in which an adsorption conveyance section 60 mentioned later is provided, overlap on the sheet conveyance direction (the direction of an arrow X of FIG. 2). And when the sheet feeding tray 31 is pulled out in the directions of an arrow Y of FIG. 2 at the time of sheet supplying, the top surface 41*b* in the downstream side is arranged to pass through under the adsorption conveyance section 60.

The leading edge regulating member 32 regulates the leading edge position of the conveyance direction of sheet P. The rear end regulating member 33 is arranged to move freely in the conveyance direction of sheet P, and regulates the rear end position of the conveyance direction of sheet P.

As shown in FIG. 3, a height detection sensor PS3, which detects the height of topmost sheet P, is disposed at the rear end regulating member 33.

In order to maintain the height of the paper sheet bundle placed on the sheet feeding tray 31 at the optimal height that suites the air blow and execute air blow to the sheet P, a control section of FIG. 9 mentioned later performs control so that an elevating/lowering motor not illustrated is driven and the sheet feeding tray 31 is raised based on a detection result of the height detection sensor PS3.

As shown in FIG. 3, the adsorption conveyance section 60 is arranged near a leading edge of sending direction of sheet P. The adsorption conveyance section 60 includes an adsorption belt 63, which rotates by winding a large roller 61, which is connected to a driving source, and two small rollers 62. A number of the penetration holes with small diameter are drilled in the adsorption belt 63. A suction device 64 is arranged in the inner part of the adsorption belt 63. The sheet P is conveyed via the adsorption belt 63 while being suctioned by the suction device 64.

As shown in FIG. 2 and FIG. 5, first blowers 40, which blows air onto the upper part of the stacked sheets P in the sheet feeding tray 31 from the side that intersects perpendicularly with the conveyance direction of the sheet P, are arranged on both sides of the sheet feeding tray 31. The first blower 40 includes ventilation fans 42, which blow air onto the upper part of the sheet P from ventilation ports 44 of both sides that intersect perpendicularly with the conveyance direction of the sheet P. A ventilation port 44 is provide near the top surface 41*b* of the side regulating member 41 in the downstream side, and is arranged so that at least a part of the ventilation port 44 overlaps with the adsorption conveyance section 60 on the sheet conveyance direction (arrow X). That is, as shown in FIG. 3, the leading edge side section of the ventilation port 44 is drawn below the adsorption belt 63.

Figure 6:
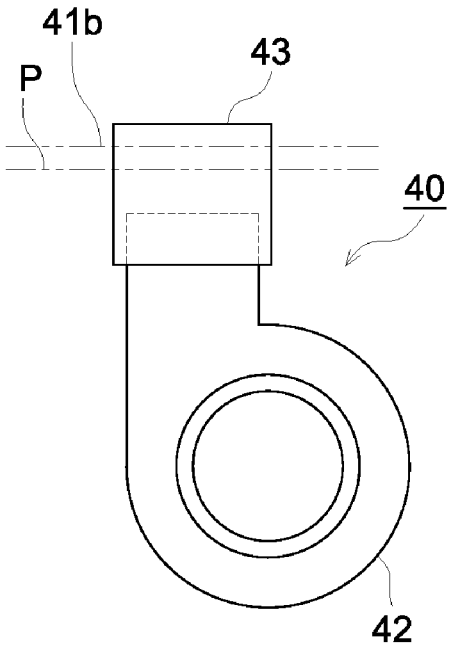
FIGS. 6(*a*) and 6(*b*) illustrate diagrams showing a first blower having a ventilation port in an ascending position.
Figure 6:
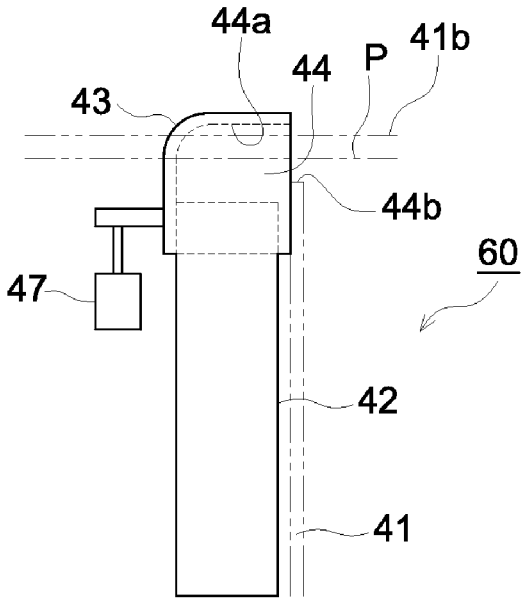
Figure 7:
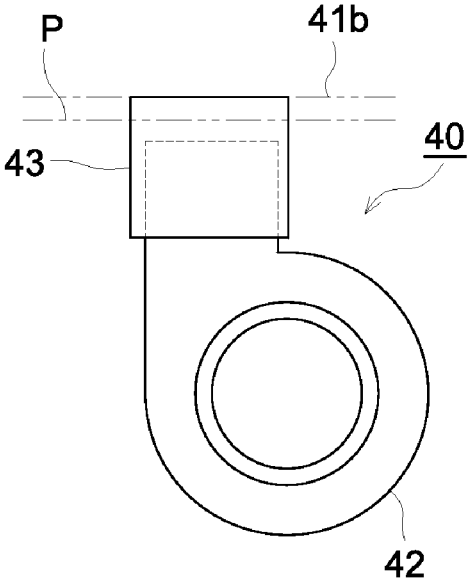
FIGS. 7(*a*) and 7(*b*) illustrate diagrams showing the first blower having a ventilation port in a descending position.
Figure 7:
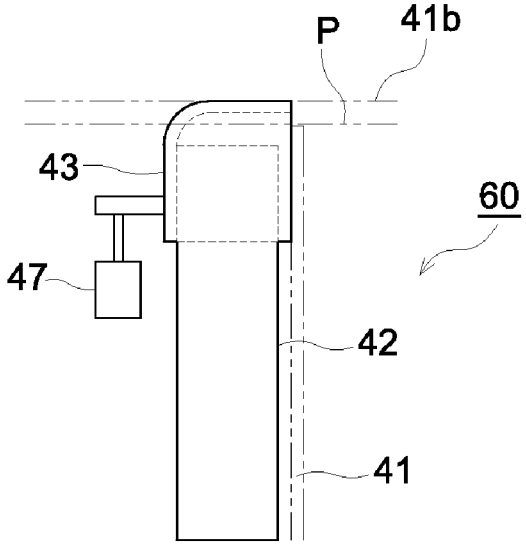

FIGS. 6(*a*) and 6(*b*) illustrate the first blower 40 in a state where the ventilation port 44 is in an ascending position. FIG. 6(*a*) is a front view and FIG. 6(*b*) is a right side view of the first blower 40. Similarly, FIGS. 7(*a*) and 7(*b*) illustrate the first blower 40 in state where the ventilation port 44 is in a descending position. FIG. 7(*a*) is a front view and FIG. 7(*b*) is a right side view of the first blower 40.

The entire body of the first blower 40 is disposed in the side regulating member 41. The ventilation port 44 is arranged to be an opening on an outlet side of a cylindrical cowling duct 43, and is arranged so that the direction is almost right-angled to the entrance side opening. The entrance side of a cowling duct 43 is fitted to freely slide on the opening end of a ventilation fan 42. The direction of the air blown upwards by the ventilation fan 42 is changed 90 degrees by the cowling duct 43. Then, the air is blown horizontally.

The cowling duct 43 is capable of ascending and descending by an elevating/lowering section 47, such as a solenoid. The ventilation port 44 opens to the upper end of the side regulating member 41. When the ventilation port 44 ascends by the elevating/lowering section 47, it is desirable to have a spatial relationship of the height of the top layer of the sheet P to be almost to the center of an upper end 44*a* and a lower end 44*b* of the ventilation port 44. When the cowling duct 43 descends by the elevating/lowering section 47, the side regulating member 41 and a upper end surface of cowling duct 43 should be arranged to be lower than the undersurface of the adsorption conveyance section 60. In the embodiment of the present invention, as shown in FIG. 7, this height is made the same as that of a top surface 41*b* of the side regulating member 41 in the downstream side, but even if the height is above the top surface 41*b*, it is acceptable as long as it does not interfere with the adsorption conveyance section 60 when the side regulating member 41 moves.

Since the first blower 40 is attached to the inside of the side regulating member 41, even when the size of sheet P is changed, the first blower 40 can also move together with the movement of the side regulating member 41. Although the first blowers 40 are provided on both side of the sheet P in this embodiment, the first blower 40 may only be provided on one side of the sheet P.

When the first blower 40 is driven and the cowling duct 43 ascends by the elevating/lowering section 47, the air blows from the ventilation port 44 to the lower part of the adsorption conveyance section 60 and the air is blown onto several sheets of the upper part of the stacked sheets P. The air is blown from one end of the sheet P towards the other end of the sheet P passing through between sheets. By this way, the several sheets on upper part of sheets P are separated into one sheet. The adsorption conveyance section 60 adsorbs a topmost sheet P from sheets P separated by blowing air.

An adsorption detection sensor PS1 arranged near an adsorption side of the adsorption belt 63 detects that the adsorption belt 63 adsorbed the uppermost surface of sheets P. The adsorption belt 63 starts rotation and begins to convey sheet P.

A feeding sensor PS2 arranged near the adsorption belt 63 on the lower stream side of the sheet conveyance direction of the sheet feeding tray 31 detects passage of the sheet P, which is to be sheet fed.

The second blower 50 is being fixed to the sheet feeding device main body 30 near the leading edge of the adsorption belt 63 on the lower stream side of the sheet conveyance direction of the sheet feeding tray 31. The second blower 50 is configured by a ventilation fan. The second blower 50 may be attached to the sheet feeding device main body 30 and may be configured so that the leading edge of the paper sheet bundle may be ventilated via a duct.

A ventilation fan 51 of the second blower 50 is attached so that a ventilation port 53 faces upward. The direction of the air blown upwards is changed by a guide plate 52. The air blows from the ventilation port 53 in a diagonally upward direction and ventilates near the adsorption belt 63 of the adsorption conveyance section 60.

The second blower 50 is controlled by a drive corresponding to the kind of sheet P. Namely, the air is blown into between sheets to securely separate each sheets when dusting powder is applied to an OHP film, a trace sheet, a coated paper sheet with a smooth surface, a sheet to which a perforations and a line pressing process have been done, and a sheet to which an offset printing has been done.

When the adsorption belt 63 continues to rotate while adsorbing the sheet P, the sheet P on the topmost layer of the stacked sheet P proceeds into the direction of arrow X illustrated and is sent out to the image forming apparatus main body "A".

As shown in FIG. 2 and FIG. 3, an intake port of the first blower 40 is covered by a shielding member 45, and can be opened and closed freely. That is, a plate-shaped shutter being the shielding member 45 is supported pivotally with an axis 46, and is opened and closed by a solenoid SOL. A control section controls the elevating/lowering section 47 and ascends and descends the cowling duct 43 at a desired timing. The control section also controls opening and closing of the shielding member 45 to switch ON (blowing) and OFF (stop) of air blow by the first blower 40.

Figure 8:
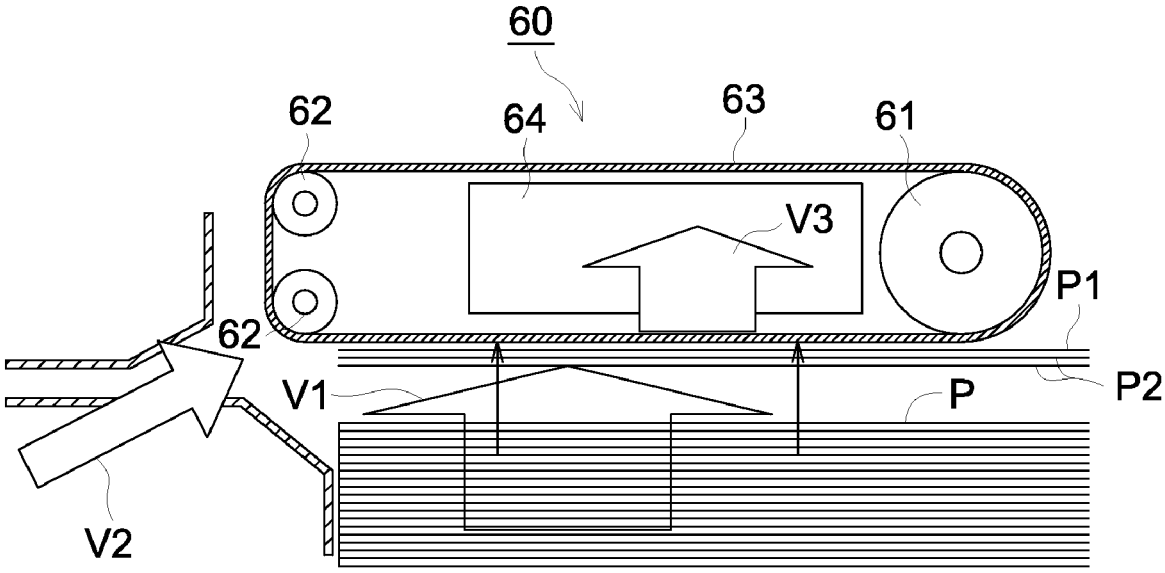
FIGS. 8(*a*) and 8(*b*) illustrate sectional views of an adsorption conveyance process of a sheet by the first blower and a second blower.
Figure 8:
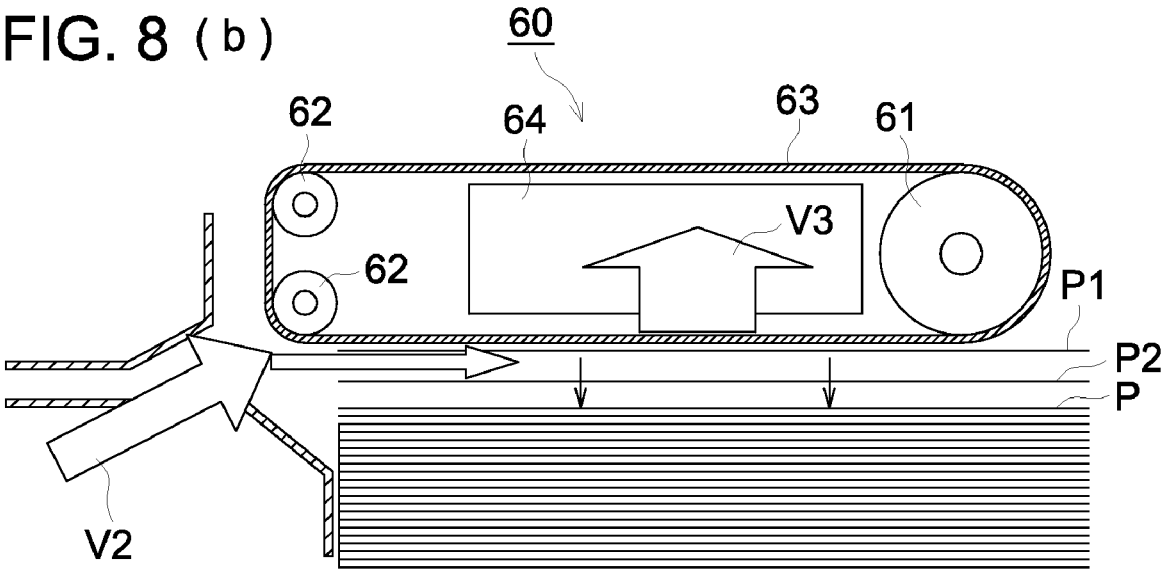

FIG. 8(*a*) and 8(*b*) illustrate sectional views showing an adsorption conveyance process of a sheet by the first blower 40 and the second blower 50.

FIG. 8(*a*) illustrates an adsorption process of a sheet. A few topmost sheets P of the paper sheet bundle loaded on the sheet feeding tray 31 are raised resisting self-weight by a first ventilation V1 (white arrow illustrated) blown upward by the first blower 40. And the sheet P is adsorbed by an air intake V3 (white arrow of illustration) by a negative pressure of the adsorption belt 63. A second ventilation V2 (white arrow of illustration) blown upwards by the second blower 50 blows onto a vicinity of a front bottom of the adsorption belt 63.

FIG. 8(*b*) illustrates a separation process of a sheet. When few of the topmost sheets of the paper sheet bundle are adsorbed by the adsorption belt 63, the shielding member 45 covers an intake port of the first blower 40 and suspends ventilation. Then, the ventilation only by the second blower 50 passes through between the papers of sheet P1 of the topmost layer and sheet P2 of the lower part of the topmost layer. The sheet P1 of the topmost layer is adsorbed by the air intake V3 of the adsorption conveyance section 60 and is separated from the sheets P of the paper sheet bundle, which excludes the sheet P1 of the topmost layer. The sheet P2 of the lower part of the sheets P1 of the topmost layer separated descends in the direction of an arrow by self-weight of the sheet P2 and accepted onto the sheets P.

Thus, by repeating the ventilations of the first blower 40 and the second blower 50, rising of several sheets of sheets P2 of the upper part of the paper sheet bundle spreads almost all over of the ventilation ports 44 and 53, and the space between each sheet becomes almost the same interval. And the air passes through this space. By this way, the separation of the sheet P1 becomes good and the sending out of the sheet P1 becomes easier. Thereby, problems, in which a sheet is damaged by rising of the sheet P1 becoming too large, and a plurality of sheets P rising while adhering together and cannot be separated, are solved.

After the separation of sheet P1 from sheet P2 is completed, an actuator not illustrated of the adsorption conveyance section 60 starts driving, and one sheet P1 adsorbed by the adsorption belt 63 is conveyed.

Figure 9:
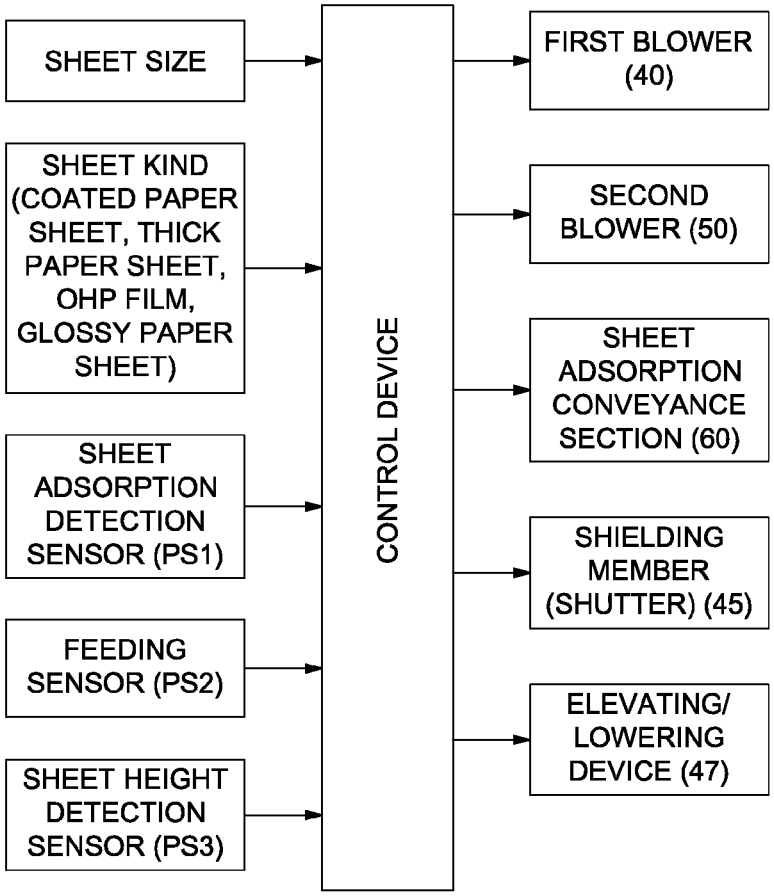
FIG. 9 illustrates a block diagram showing a configuration of control of the sheet feeding device.
Figure 10:
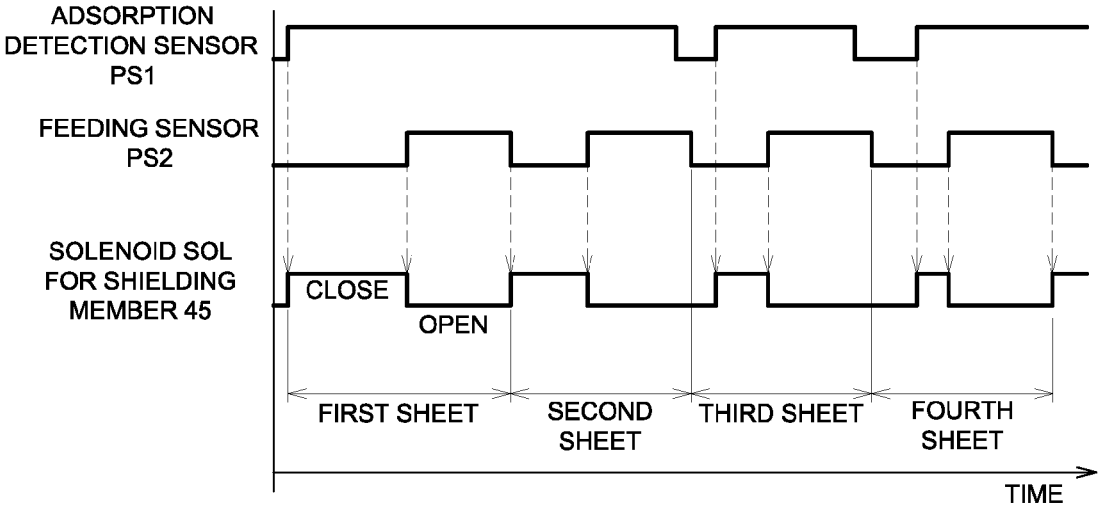
FIG. 10 illustrates a timing chart indicating the control of the sheet feeding device.

FIG. 9 illustrates a block diagram showing a configuration of control of the sheet feeding device. FIG. 10 illustrates a timing chart showing control of the sheet feeding device. The control section is configured by a computer. Data of sheet size and sheet kind (a coated paper sheet, a thick paper sheet, an OHP film, a glossy paper sheet) is inputted, and ON and OFF signals from a sheet adsorption detection sensor PS1, a feeding sensor PS2, a sheet height detection sensor PS3 are inputted into the control section. Based on this information, the first blower 40, the second blower 50, the sheet adsorption conveyance section 60, the shielding member 45, and the elevating/lowering section 47 are controlled.

When the paper sheet bundle is set in the sheet feeding tray 31 and sheet feed start information is inputted into the control section, the elevating/lowering section 47 raises the cowling duct 43, and the first blower 40 starts ventilating. Several sheets of the upper part of the paper sheet bundle are pressured upwards, and if the adsorption detection sensor PS1 detects that the adsorption belt 63 of the adsorption conveyance section 60 has adsorbed sheet P1, the control section will control the shielding member 45 and will switch the air blowing by first blower 40 to OFF.

Namely, the control section controls not to perform the air blow by covering the intake port of the first blower 40 with the shielding member 45 during the time from the adsorption detection sensor PS1 (refer to FIG. 2) disposed near the adsorption belt 63 detects the adsorption of the sheet P1 by the adsorption conveyance section 60 until the start of sending out of the sheet P1 by the adsorption conveyance section 60.

When the adsorption sensor PS1 is detecting the adsorption of the sheet P1 and the feeding sensor PS2 is not detecting the sheet P1, that is, only before sending of the sheet P1 is performed, the air blow is performed by having the shielding member 45 at an open state.

Although a cover time of the shielding member 45 may not be exactly the same as that of the above-mentioned timing, if limiting only to the moment of a start of sending of sheet P1, the cover time will become extremely short and the separation effect of sheet P1 will not be acquired. When covering the shielding member 45 at all times when the adsorption detection sensor PS1 detects adsorption of sheet P1, the sheet P1 will not be adsorbed to the adsorption belt 63 because of the insufficient push up by the air and a poor sheet feed is generated. That is, the poor sheet feeding is generated, even if the cover time is too much or too little. As a standard timing, as shown in FIG. 10, as for a first sheet P, the shielding member 45 is closed after the solenoid SOL is turned ON when the adsorption detection sensor PS1 is turned ON and the feeding sensor PS2 is in the state of being turned OFF before the sheet feeding starts. When the feeding sensor PS2 is ON at the time of sheet feeding, the shielding member 45 is opened.

The sheet P2 being a second sheet is discharged. Then, the adsorption detection sensor PS1 changes from ON to OFF. When a predetermined time lapses after the feeding sensor PS2 is turned OFF, the adsorption detection sensor PS1 is turned ON again by the sheet P being a third sheet, turns on the solenoid SOL and closes the shielding member 45.

The above is a standard timing. It is desirable to determine the optimal timing by the sheet size and the paper quality, to arrange the control section to memorize and to control based on this memory data.

The ventilation fan 42 is capable of its rotation being controlled by the control section and is arranged to control the air amount according to the size, paper quality and basis weight of the sheet P, and to blow the optimal amount of air. The elevating/lowering section 47 is capable of elevating/lowering the cowling duct 43 according to the sheet feeding status during sheet feeding. And the optimal amount of air for a certain specific sheet P and the timing of elevating/lowering of the cowling duct 43 are memorized by the control section of the image forming apparatus just like the timing of opening and closing of the shielding member 45 mentioned above. The sheet size and paper quality of the sheet P accepted in the sheet feeding tray 31 can be memorized by inputting from an operation section. By doing thus, the control section may be set to perform the blowing that suites the paper quality at all times.

Refilling of the sheets P is performed by pulling out the sheet feeding tray 31 from the sheet feeding device LT along the guide rail 34. If the cowling duct 43 is ascending at this time, it will interfere with the adsorption belt 63 of the adsorption conveyance section 60. Then, when pulling out the sheet feeding tray 31, the cowling duct 43 and/or ventilation port 44 are descended to a downward position by the elevating/lowering device 47. The descendent position of the ventilation port 44 only needs to be at the height where the cowling duct 43 does not interfere with the adsorption conveyance section 60 and does not necessary have to be lower than the top surface 41*b* of the side regulating member 41 and may be higher than the top surface 41*b*.

As mentioned above, the cowling duct 43 needs to be in an ascended position when the first blower 40 is ventilating and in a descendent position when the sheet feeding tray 31 is pulled out. The elevating/lowering section 47 is operated by the control section to satisfy such conditions. In the embodiment, although the solenoid is used as the elevating/lowering section 47, a motor may be used for the elevating/lowering section 47.

Normally, since the operation of the image forming apparatus is stopped when the sheet feeding tray 31 is pulled out, the first blower 40 suspends ventilation. Therefore, as an example, the first blower 40 may be controlled so that when the first blower 40 is ventilating, it is positioned at an ascended position, and when the first blower 40 stops ventilating, it maintains a descended position. As one of such configurations, a configuration in which the ascending and descending by air pressure of the ventilation fan 42 can be employed by having the cowling duct 43 made into lightweight and fitted to ascend and descend with light power.

In the above-mentioned embodiment, as explained above, since the ventilation port 44 and the adsorption conveyance section 60 are arranged so that at least a part of the ventilation port 44 and a part of the adsorption conveyance section 60 overlap on the sheet conveyance direction (arrow X), even small sized sheets P can be separated into one sheet. Since the sheets right below the adsorption conveyance section 60 are separated into one sheet by the air from the ventilation port 44, the adsorption conveyance section 60 becomes easy to adsorb the topmost sheet P.

Thus, in the sheet conveyance direction, it is desirable to have a section that an area, in which the ventilation port 44 is provided, and an area, in which the adsorption conveyance section 60 is provided, overlap. When the ventilation port 44 blows air onto near the leading edge of the adsorption conveyance section 60, the following problem occurs. A problem of the poor sheet feeding occurs by the air from the ventilation port 44 flows onto the leading edge side of the adsorption conveyance section 60 and moves the sheet P forward. The embodiment of the present invention is performed as follows to resolve this problem.

Figure 11:
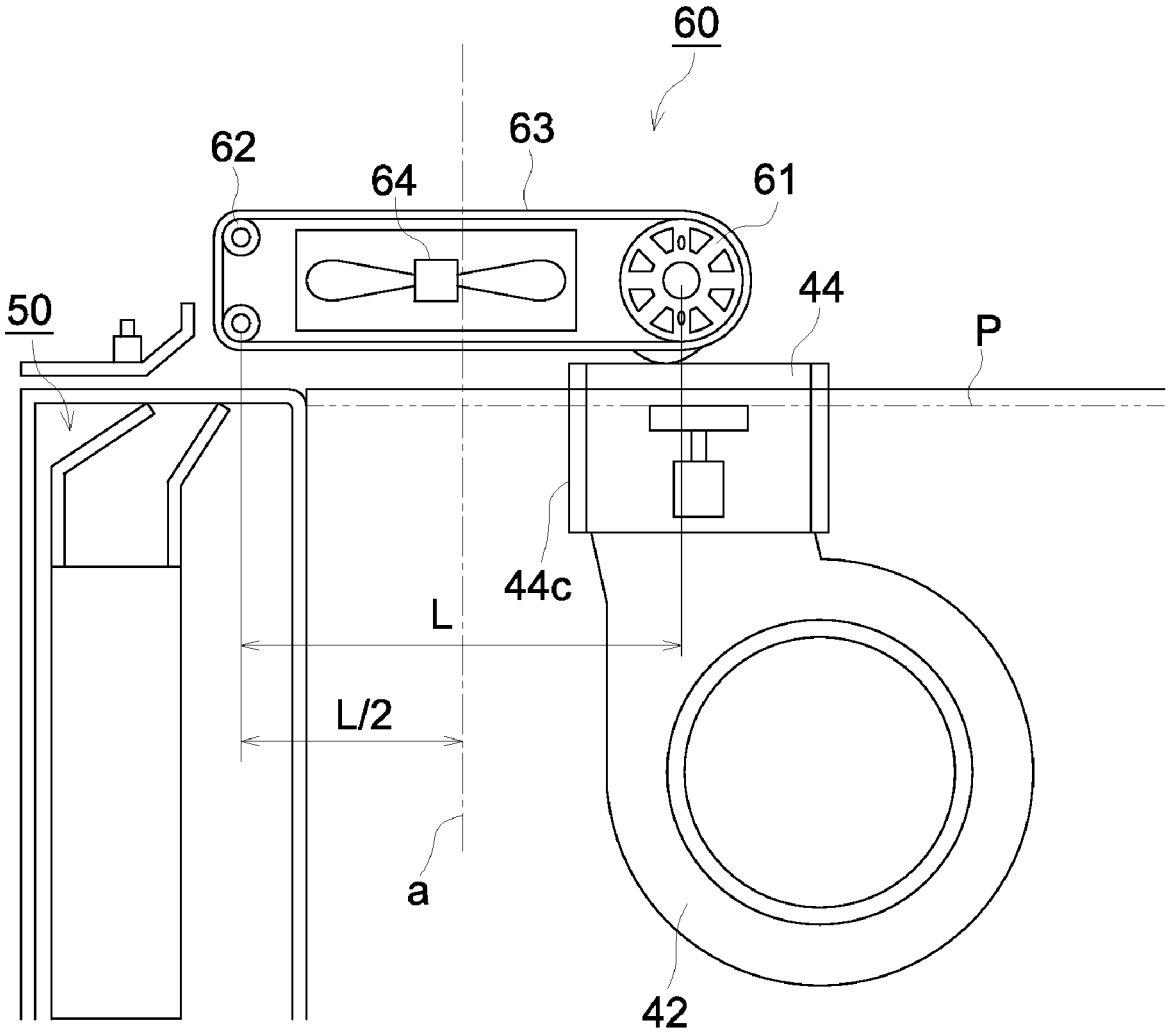
FIG. 11 illustrates a diagram explaining a desirable spatial relationship of a ventilation port and an adsorption conveyance section.

FIG. 11 illustrates a figure explaining the desirable spatial relationship of the ventilation port 44 and the adsorption conveyance section 60. Although a range shown by "L" of the drawing, that is, the undersurface of the adsorption belt 63, serves as an adsorption side, when the center of the conveyance direction of this adsorption side is set as a line "a", a leading edge side 44*c* of the ventilation port 44 is kept from reaching ahead of the line "a" in the conveyance direction. By doing thus, the air from the ventilation port 44 is kept from flowing into the leading edge section of the adsorption conveyance section 60, and can prevent the poor sheet feed.

The sheet feeding device LT, which has a large capacity, is connected to the image forming apparatus main body "A". Although the sheet feeding device LT was explained as the sheet feeding device of the present invention, the sheet feeding device is also applicable to the sheet feeding cassette 10 disposed in the image forming apparatus main body "A".

What is claimed is:

1. A sheet feeding device, comprising:

a sheet feeding tray which stacks a paper sheet bundle formed by a plurality of sheets;

a first blower which blows air to a side edge of the paper sheet bundle stacked on the sheet feeding tray;

a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet one by one;

wherein a first area in which the adsorption conveyance section is provided, and a second area in which a ventilation port of the first blower is provided, respectively includes an overlapping area in which the first area and the second area overlap on the sheet conveyance direction; and wherein the leading edge of the ventilation portion of the first blower in the sheet conveyance direction is arranged to be upstream side of a position of a half the length of a adsorption side of the adsorption conveyance section in the sheet conveyance direction.

2. The sheet feeding device of claim 1, further comprising a control section which controls the first blower, the control section is configured to control the air amount of the first blower.

3. The sheet feeding device of claim 1, wherein the first blower comprises a shielding member which turns ON/OFF of air blow by the first blower.

4. An image forming apparatus, comprising:

an image forming section which forms a toner image on an image bearing member;

a transfer section which transfers the toner image formed on the image bearing member to a sheet;

a sheet feeding device which conveys the sheet to the transfer section; and a fixing device which fixes the toner image transferred to the sheet by heating the sheet, wherein the sheet feeding device comprises:

a sheet feeding tray which stacks a paper sheet bundle formed by a plurality of sheets;

a first blower which blows air to a side edge of the paper sheet bundle stacked on the sheet feeding tray;

a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet one by one;

wherein a first area in which the adsorption conveyance section is provided, and a second area in which a ventilation port of the first blower is provided, respectively includes an overlapping area in which the first area and the second area overlap on the sheet conveyance direction; and wherein the leading edge of the ventilation portion of the first blower in the sheet conveyance direction is arranged to be upstream side of a position of a half the length of a adsorption side of the adsorption conveyance section in the sheet conveyance direction.

5. A sheet feeding device, comprising:

a sheet feeding tray which stacks a paper sheet bundle formed by a plurality of sheets;

a first blower which blows air to a side edge of the paper sheet bundle stacked on the sheet feeding tray;

a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet one by one;

wherein a first area in which the adsorption conveyance section is provided, and a second area in which a ventilation port of the first blower is provided, respectively includes an overlapping area in which the first area and the second area overlap on the sheet conveyance direction; and wherein the first blower comprises a shielding member which turns ON/OFF of air blow by the first blower.

6. The sheet feeding device of claim 5, further comprising a control section which controls the first blower, the control section is configured to control the air amount of the first blower.

7. An image forming apparatus, comprising:

an image forming section which forms a toner image on an image bearing member;

a transfer section which transfers the toner image formed on the image bearing member to a sheet;

a sheet feeding device which conveys the sheet to the transfer section; and a fixing device which fixes the toner image transferred to the sheet by heating the sheet, wherein the sheet feeding device comprises:

a sheet feeding tray which stacks a paper sheet bundle formed by a plurality of sheets;

a first blower which blows air to a side edge of the paper sheet bundle stacked on the sheet feeding tray;

a second blower which blows air to a leading edge of the paper sheet bundle in a sheet conveyance direction from a forward side of the paper sheet bundle in the sheet conveyance direction; and an adsorption conveyance section which adsorbs a topmost sheet of the paper sheet bundle stacked on the sheet feeding tray and conveys the topmost sheet one by one;

wherein a first area in which the adsorption conveyance section is provided, and a second area in which a ventilation port of the first blower is provided, respectively includes an overlapping area in which the first area and the second area overlap on the sheet conveyance direction;

wherein the first blower comprises a shielding member which turns ON/OFF of air blow by the first blower.

* * * * *